US011585126B2

(12) United States Patent
Yamada et al.

(10) Patent No.: US 11,585,126 B2
(45) Date of Patent: Feb. 21, 2023

(54) VEHICLE DOOR LOCK STRUCTURE

(71) Applicant: AISIN CORPORATION, Kariya (JP)

(72) Inventors: Yusuke Yamada, Kariya (JP); Masanari Iwata, Kariya (JP); Yoshiki Odaka, Kariya (JP)

(73) Assignee: AISIN CORPORATION, Aichi (JP)

( * ) Notice: Subject to any disclaimer, the term of this patent is extended or adjusted under 35 U.S.C. 154(b) by 239 days.

(21) Appl. No.: 16/710,363

(22) Filed: Dec. 11, 2019

(65) Prior Publication Data

US 2020/0190868 A1 Jun. 18, 2020

(30) Foreign Application Priority Data

Dec. 14, 2018 (JP) ..... JP2018-234144

(51) Int. Cl.
*E05B 79/08* (2014.01)
*E05B 85/02* (2014.01)

(52) U.S. Cl.
CPC ..... *E05B 79/08* (2013.01); *E05B 85/02* (2013.01)

(58) Field of Classification Search
CPC ..... E05B 79/00; E05B 79/02; E05B 79/08; E05B 81/02; E05B 81/06; E05B 81/16; E05B 81/36; E05B 81/42; E05B 85/02; E05B 85/20; E05B 85/24; E05B 85/243; E05B 85/26; E05B 15/0053; E05B 15/008; E05B 15/04; E05B 2015/0403; E05B 2015/042; E05B 2015/0427;
(Continued)

(56) References Cited

U.S. PATENT DOCUMENTS 8,438,888 B2 * 5/2013 Akizuki ..... E05B 81/36 70/237
9,791,885 B2 * 10/2017 Suzumura ..... G05G 5/06
2019/0017291 A1 * 1/2019 Inan ..... E05B 83/24

FOREIGN PATENT DOCUMENTS

CN 106103869 A * 11/2016 ..... E05B 77/06
DE 112016002502 T5 * 2/2018 ..... E05B 79/20
(Continued)

OTHER PUBLICATIONS

Office Action (Notice of Reasons for Refusal) dated Jul. 21, 2022, by the Japanese Patent Office in corresponding Japanese Patent Application No. 2018-234144 and an English Translation of the Office Action. (6 pages).

*Primary Examiner* — Kristina R Fulton
*Assistant Examiner* — Noah Horowitz
(74) *Attorney, Agent, or Firm* — Buchanan Ingersoll & Rooney PC

(57) ABSTRACT

A vehicle door lock structure includes: a housing; an active lever supported by the housing to be displaceable relative to the housing between locked position where the active lever prohibits opening of a vehicle door by a door opening operation of a door operation handle provided on the vehicle door and an unlocked position where the active lever allows the opening of the vehicle door by the door opening operation of the door operation handle; and a spring configured to selectively hold the active lever at either the locked or unlocked position. The housing includes a held portion held by the spring. The spring includes: locked-position and unlocked-position holders respectively holding the held portion such that the active lever is held at the locked and unlocked positions. The active lever includes a spring holder that holds the spring.

5 Claims, 8 Drawing Sheets

(58) Field of Classification Search
CPC ..... E05B 2015/0437; E05B 2015/0496; Y10T 292/1047; Y10T 292/1078; Y10T 292/1082; Y10S 292/23; Y10S 292/53; Y10S 292/61; Y10S 292/64
See application file for complete search history.

(56) References Cited

FOREIGN PATENT DOCUMENTS

| | | | | | |
|---|---|---|---|---|---|
| FR | 3026767 | A1 * | 4/2016 | ..... | E05B 85/243 |
| JP | S56-149766 | U | 11/1981 | | |
| JP | 2002132363 | A | 5/2002 | | |
| WO | WO-2013108558 | A1 * | 7/2013 | ..... | E05B 77/26 |
| WO | WO-2015105096 | A1 * | 7/2015 | ..... | E05B 81/16 |

* cited by examiner

VEHICLE DOOR LOCK STRUCTURE

CROSS REFERENCE TO RELATED APPLICATIONS

This application is based on and claims priority under 35 U.S.C. § 119 to Japanese Patent Application 2018-234144, filed on Dec. 14, 2018, the entire contents of which are incorporated herein by reference.

TECHNICAL FIELD

This disclosure relates to a vehicle door lock structure.

BACKGROUND DISCUSSION

In the related art, a vehicle door lock structure provided on a vehicle door is known. For example, JP 2002-132363A (Reference 1) discloses a vehicle door lock structure including a housing, a locking lever (hereinafter referred to as an "active lever"), and a torsion spring. The housing has a pin portion which rotatably supports the active lever and a boss portion which supports the torsion spring. The torsion spring has a pair of arm portions. The active lever has a substantially fan-shaped body and an engagement portion which is engaged with the pair of arm portions. The engagement portion has a shape that protrudes from the body toward the housing. The pair of arm portions may selectively hold the engagement portion at either a first position or a second position. When the pair of arm portions hold the engagement portion at the first position, the active lever is held at an unlocked position to allow a vehicle door to be opened. When the pair of arm portions hold the engagement portion at the second position, the active lever is held at a locked position to prevent the vehicle door from being opened.

When the vehicle door lock structure is assembled, in a state where the torsion spring is assembled to the boss portion of the housing, the active lever is assembled to the pin portion such that the engagement portion is located between the pair of arm portions.

In the vehicle door lock structure described in Reference 1, since the engagement portion is hidden by the body when the active lever is assembled to the housing, it is difficult to assemble the active lever to the pin portion such that the engagement portion is located between the pair of arm portions.

Thus, a need exists for a vehicle door lock structure which is not susceptible to the drawback mentioned above.

SUMMARY

A vehicle door lock structure according to an aspect of the present disclosure includes a housing, an active lever supported by the housing so as to be displaceable relative to the housing between a locked position where the active lever prohibits opening of a vehicle door by a door opening operation of a door operation handle provided on the vehicle door and an unlocked position where the active lever allows the opening of the vehicle door by the door opening operation of the door operation handle, and a spring configured to selectively hold the active lever at either the locked position or the unlocked position. The housing includes a held portion that is held by the spring, the spring includes a locked-position holder that holds the held portion such that the active lever is held at the locked position and an unlocked-position holder that holds the held portion such that the active lever is held at the unlocked position, and the active lever includes a spring holder that holds the spring.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
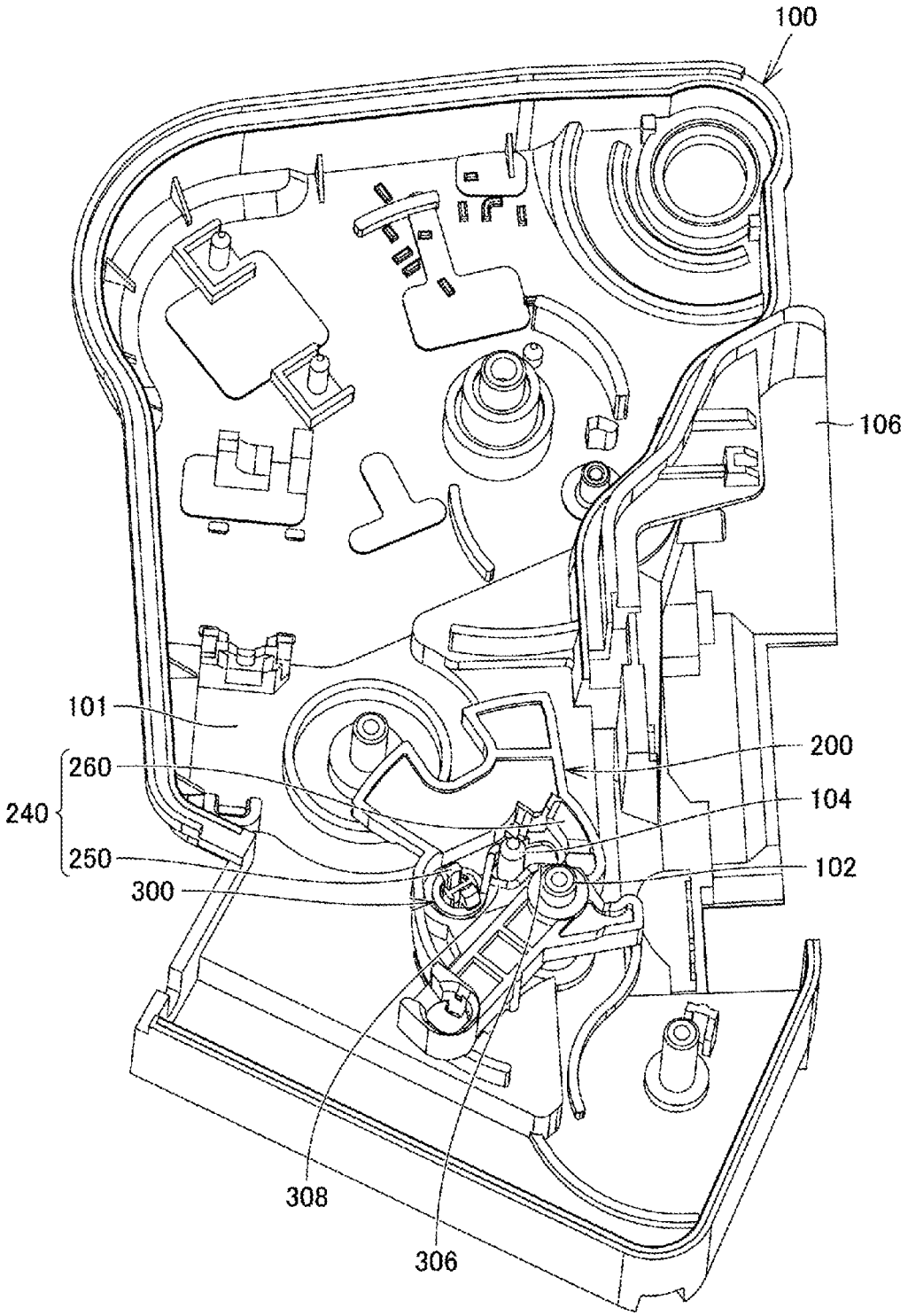
FIG. 1 is a perspective view illustrating a part of a vehicle door lock structure according to an embodiment disclosed here.

Embodiments disclosed here will be described with reference to the drawings. In addition, in the drawings referred to below, the same reference numerals will be given to the same or corresponding members.

FIG. 1 is a perspective view illustrating a part of a vehicle door lock structure according to an embodiment disclosed here. The vehicle door lock structure is assembled in an area of a vehicle door defined by a door outer panel and a door inner panel. The vehicle door lock structure of the present embodiment includes a housing 100, an active lever 200, a spring 300, a cover 400 (see FIGS. 5 and 7), and a latch unit (not illustrated).

The housing 100 accommodates therein the active lever 200 and the spring 300. In addition, although not illustrated, the housing 100 accommodates therein, an inside open lever, an outside open lever, an open link, a control lever, a motor, a worm, a worm wheel, and the like, in addition to the active lever 200 and the spring 300. These members and the latch unit are the same as those described in, for example, JP 2015-132065A.

Figure 2:
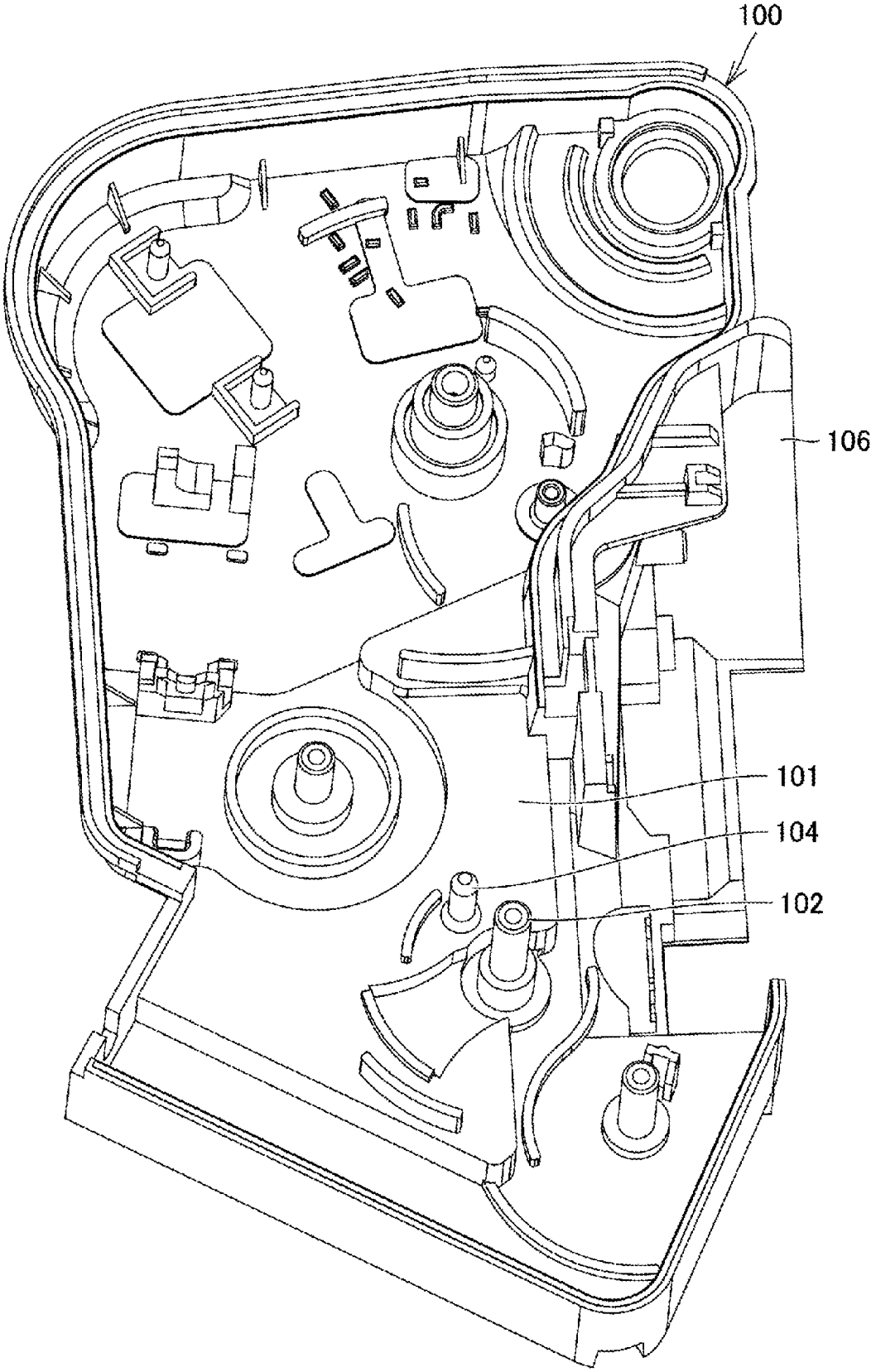
FIG. 2 is a perspective view of a housing of the vehicle door lock structure.

FIG. 2 is a perspective view of the housing of the vehicle door lock structure. As illustrated in FIG. 2, the housing 100 includes a base 101, a support shaft 102, a held portion 104, and a latch unit connection portion 106.

The base 101 has a portion for supporting each member described above. The base 101 has a flattened portion.

The support shaft 102 rotatably supports the active lever 200. The support shaft 102 has a shape that protrudes from the flat portion of the base 101 in a direction orthogonal to the flat portion (toward the cover 400).

The held portion 104 is a portion that is held by the spring 300. The held portion 104 is provided at a position spaced apart from the support shaft 102. The held portion 104 has a shape that protrudes from the flat portion of the base 101 in a direction orthogonal to the flat portion (toward the cover 400). The held portion 104 is formed in a cylindrical shape.

The latch unit connection portion 106 is a portion to which the latch unit is connected. The latch unit connection portion 106 is connected to the base 101.

The active lever 200 is supported by the housing 100 so as to be displaceable relative to the housing 100 between a locked position where the active lever 200 prohibits the opening of the vehicle door by a door opening operation of a door operation handle provided on the vehicle door and an unlocked position where the active lever 200 allows the opening of the vehicle door by the door opening operation of the door operation handle. Specifically, the active lever 200 is rotatably supported by the support shaft 102.

When the active lever 200 is at the unlocked position, a lift lever of the latch unit is pushed up via the inside open lever or the outside open lever and the open link when the door opening operation of the door operation handle is performed, so that a ratchet of the latch unit rotates. Then, since the engagement between a latch and the ratchet is released so that the latch rotates, the engagement between the latch and a striker provided on a vehicle is released (the vehicle door is opened).

Meanwhile, when the active lever 200 is at the locked position, since the lift lever is not pushed up via the inside open lever or the outside open lever and the open link even if the door opening operation of the door operation handle is performed, the ratchet does not rotate. Therefore, since the engagement between the latch and the ratchet is maintained, the engagement between the latch and the striker is maintained (the vehicle door is kept closed).

Figure 3:
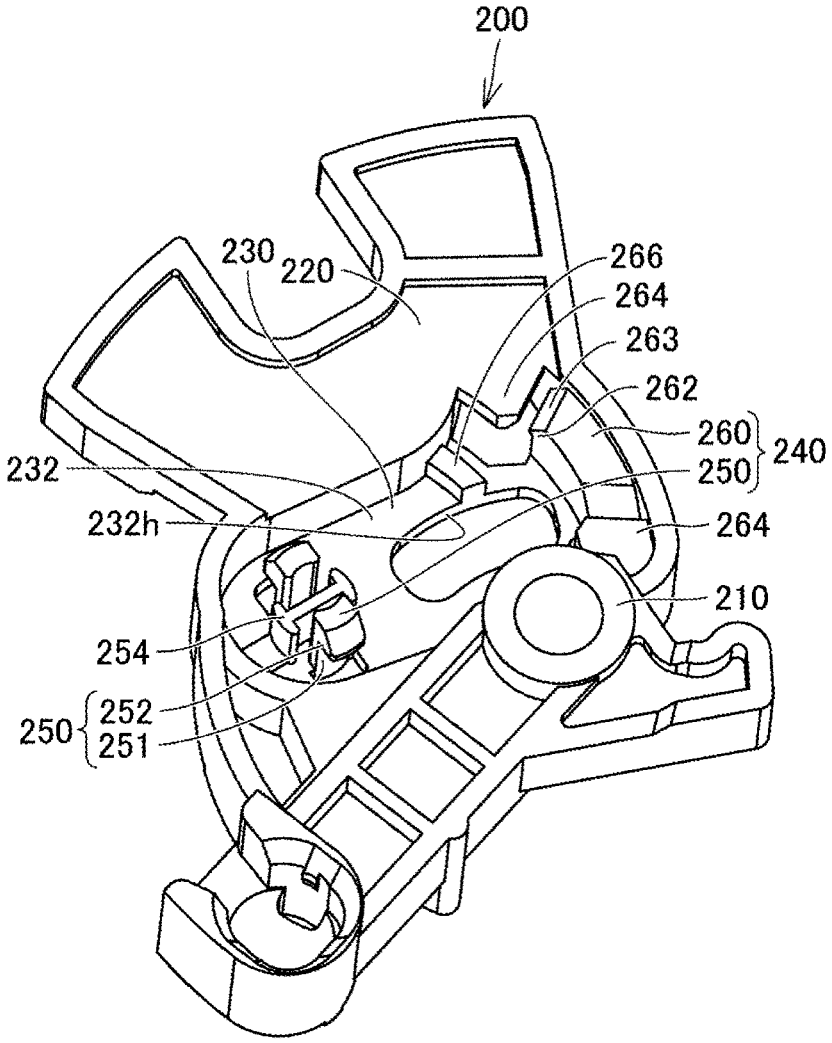
FIG. 3 is a perspective view of an active lever of the vehicle door lock structure.

FIG. 3 is a perspective view of the active lever of the vehicle door lock structure. The active lever 200 has a base facing surface that faces the base 101 and a cover facing surface that faces the cover 400. In FIG. 3, the cover facing surface of the active lever 200 is illustrated. As illustrated in FIG. 3, the active lever 200 includes a rotating shaft portion 210, a lever connection portion 220, a recess 230, and a spring holder 240.

The rotating shaft portion 210 is a portion that is supported by the support shaft 102. The rotating shaft portion 210 is formed in a cylindrical shape.

The lever connection portion 220 is a portion that is connected to the control lever. The lever connection portion 220 is engaged with the worm wheel. Therefore, it is also possible to rotate the active lever 200 with a motor via the worm wheel and the worm.

The recess 230 is provided between the rotating shaft portion 210 and the lever connection portion 220. The recess 230 has a shape that is recessed from the cover facing surface toward the base facing surface of the lever connection portion 220. The recess 230 has a bottom wall 232 located closer to the base facing surface side than the cover facing surface of the lever connection portion 220. The bottom wall 232 is provided with an insertion through-hole **232*h* which allows the held portion 104 to be inserted therethrough from the base facing surface side to the cover facing surface side. The insertion though-hole 232*h* is formed in a shape that allows the active lever 200 to be displaced between the locked position and the unlocked position with the held portion 104** inserted therethrough.

The spring holder 240 holds the spring 300. The spring holder 240 is provided on the cover facing surface in the recess 230. Details of the spring holder 240 will be described later.

Figure 4:
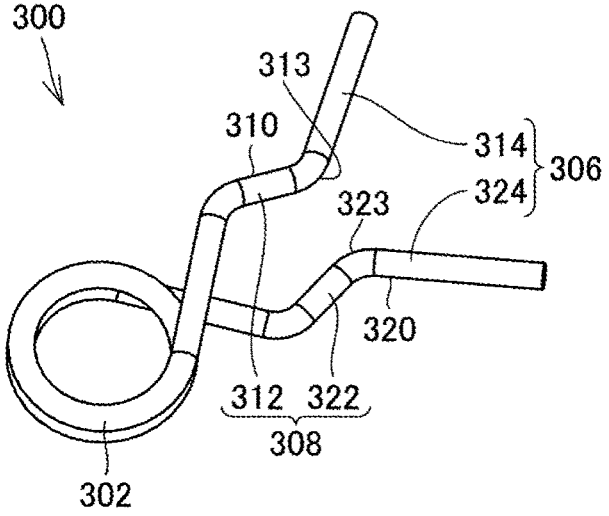
FIG. 4 is a perspective view of a spring of the vehicle door lock structure.

The spring 300 is a member that may selectively hold the active lever 200 at either the locked position or the unlocked position. The spring 300 is held by the spring holder 240 of the active lever 200. FIG. 4 is a perspective view of the spring of the vehicle door lock structure illustrated in FIG. 1. The spring 300 has a locked-position holder 306 which holds the held portion 104 such that the active lever 200 is held at the locked position and an unlocked-position holder 308 which holds the held portion 104 such that the active lever 200 is held at the unlocked position.

As illustrated in FIG. 4, the spring 300 includes a coil portion 302, a first leg portion 310, and a second leg portion 320.

The first leg portion 310 extends from one end of the coil portion 302. The first leg portion 310 includes a first element 312 connected to one end of the coil portion 302 and a second element 314 connected to the tip end of the first element 312. A boundary portion 313 between the first element 312 and the second element 314 has a shape that is bent so as to be convex toward the second leg portion 320.

The second leg portion 320 extends from the other end of the coil portion 302. The second leg portion 320 is located closer to the base facing surface side than the first leg portion 310. The second leg portion 320 includes a third element 322 connected to the other end of the coil portion 302 and a fourth element 324 connected to the tip end of the third element 322. A boundary portion 323 between the third element 322 and the fourth element 324 has a shape that is bent so as to be convex toward the first leg portion 310.

Figure 6:
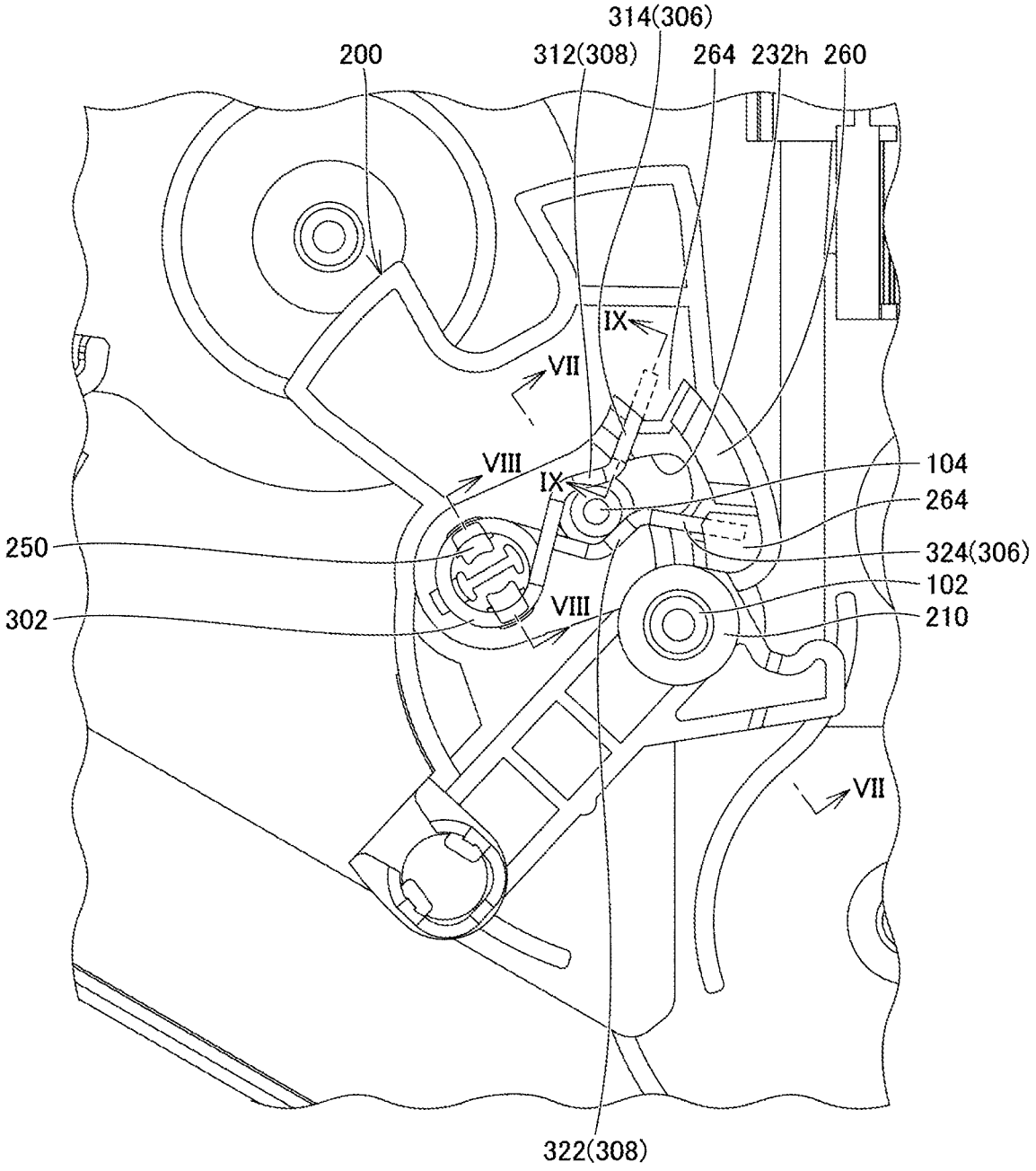
FIG. 6 is a plan view illustrating a state where the active lever and the spring are assembled to the housing at an unlocked position.

The second element 314 of the first leg portion 310 and the fourth element 324 of the second leg portion 320 constitute the locked-position holder 306. More specifically, the second element 314 and the fourth element 324 support the held portion 104 fitted therebetween, so that the active lever 200 is held at the locked position. This state is illustrated in FIG. 6.

Figure 10:
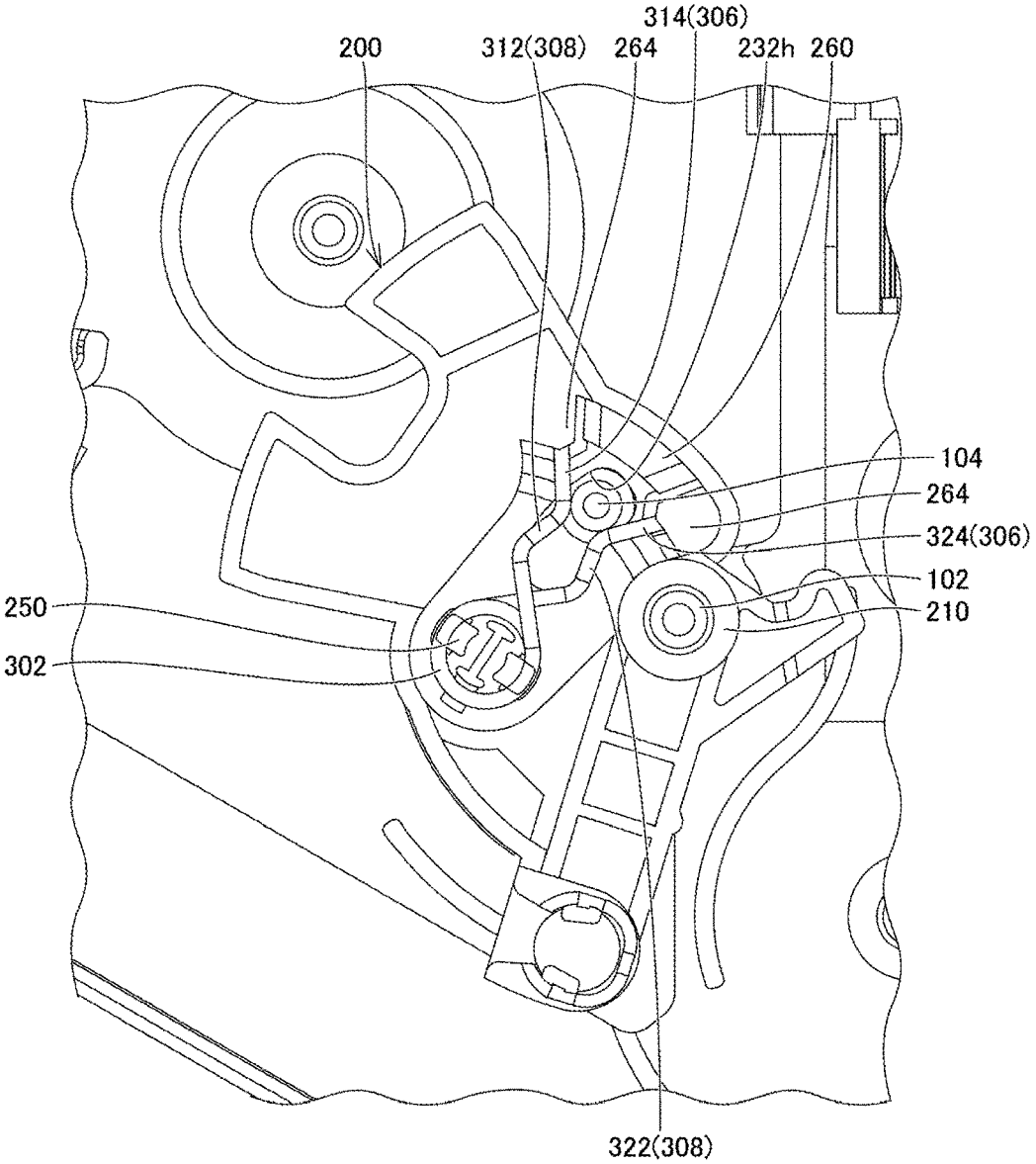
FIG. 10 is a plan view illustrating a state where the active lever and the spring are assembled to the housing at a locked position.

The first element 312 of the first leg portion 310 and the third element 322 of the second leg portion 320 constitute the unlocked-position holder 308. More specifically, the first element 312 and the third element 322 support the held portion 104 fitted therebetween, so that the active lever 200 is held at the unlocked position. This state is illustrated in FIG. 10.

The respective boundary portions 313 and 323 are formed between the locked-position holder 306 and the unlocked-position holder 308. The respective boundary portions 313 and 323 constitute a moderator that generates a moderation feeling when the held portion 104 moves between the locked-position holder 306 and the unlocked-position holder 308.

Figure 5:
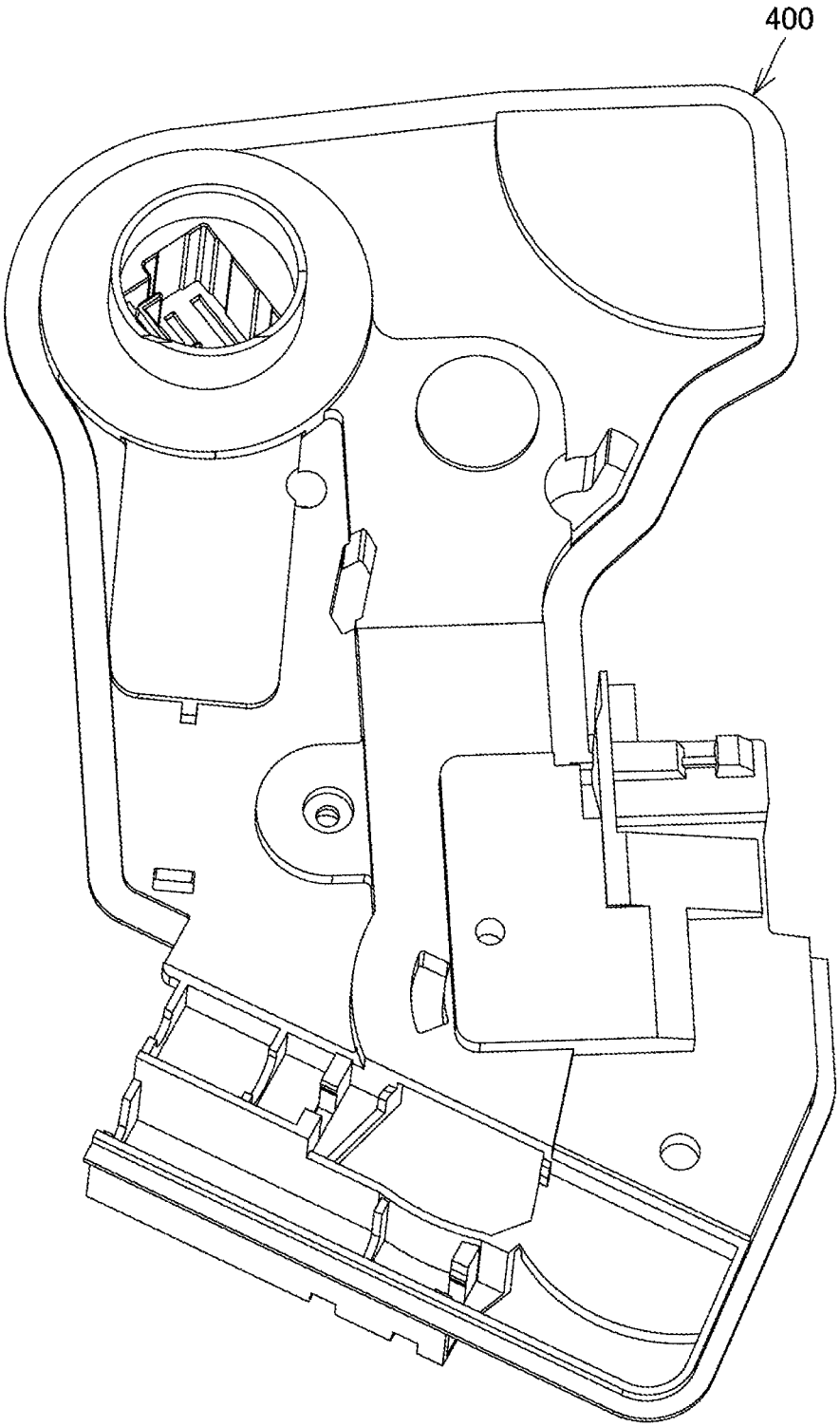
FIG. 5 is a perspective view of a cover of the vehicle door lock structure.

FIG. 5 is a perspective view of the cover of the vehicle door lock structure. The cover 400 may be assembled to the housing 100. The cover 400 accommodates therein the active lever 200 and the spring 300 together with the housing 100 in a state of being assembled to the housing 100.

Figure 7:
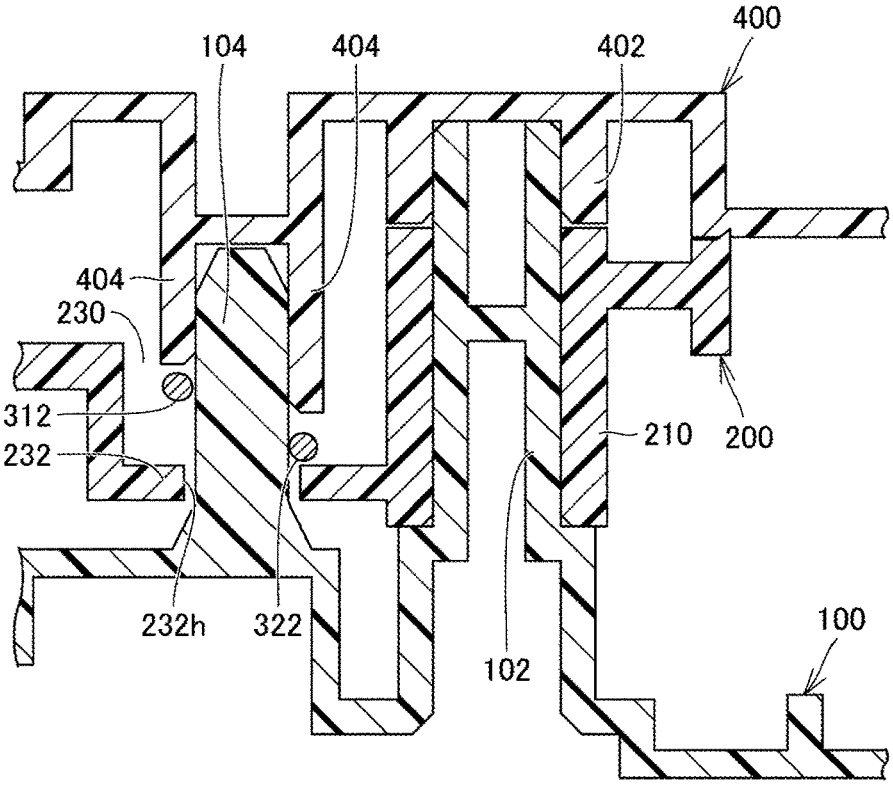
FIG. 7 is a cross-sectional view taken along line VII-VII in FIG. 6.

FIG. 6 is a plan view illustrating a state where the active lever and the spring are assembled to the housing at the unlocked position. FIG. 7 is a cross-sectional view taken along line VII-VII in FIG. 6. As illustrated in FIG. 7, the cover 400 has a cylindrical portion 402 which is fitted onto the support shaft 102 and a fitting portion 404 which is fitted onto the held portion 104. The fitting portion 404 has a shape that overlaps with the first leg portion 310 and the second leg portion 320 in a direction parallel to the axial direction (the vertical direction in FIG. 7) of the held portion 104.

Here, the spring holder 240 will be described. As illustrated in FIG. 3, the spring holder 240 includes a coil-portion holder 250 and a leg-portion holder 260.

The coil-portion holder 250 is a portion that holds the coil portion 302. The coil-portion holder 250 includes a pair of column portions 251 rising from the bottom wall 232 and engagement portions 252.

Figure 8:
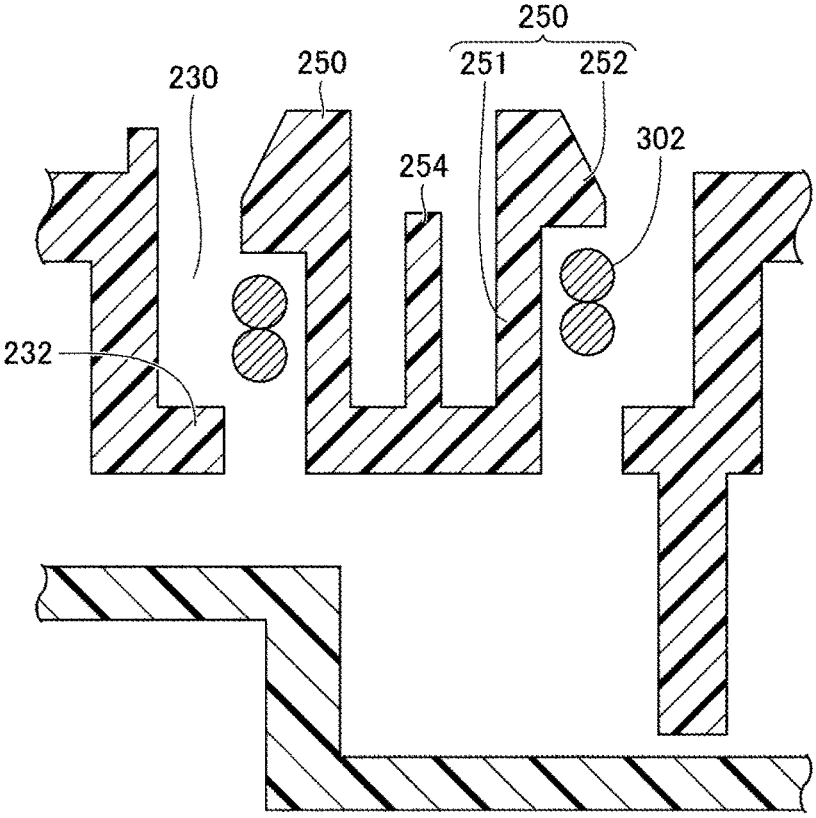
FIG. 8 is a cross-sectional view taken along line VIII-VIII in FIG. 6.

FIG. 8 is a cross-sectional view taken along line VIII-VIII in FIG. 6. The engagement portions 252 have a shape that protrudes outward in the radial direction of the coil portion 302 from the tip ends of the column portions 251. The engagement portions 252 are engaged with the coil portion 302 disposed around the pair of column portions 251 in the direction from the cover facing surface side to the base facing surface side, thereby regulating the displacement of the coil portion 302 to the cover 400 side.

The active lever 200 further has a positioning portion 254. The positioning portion 254 is provided between the pair of column portions 251. The positioning portion 254 regulates the displacement of the coil portion 302 inside the recess 230.

Figure 11:
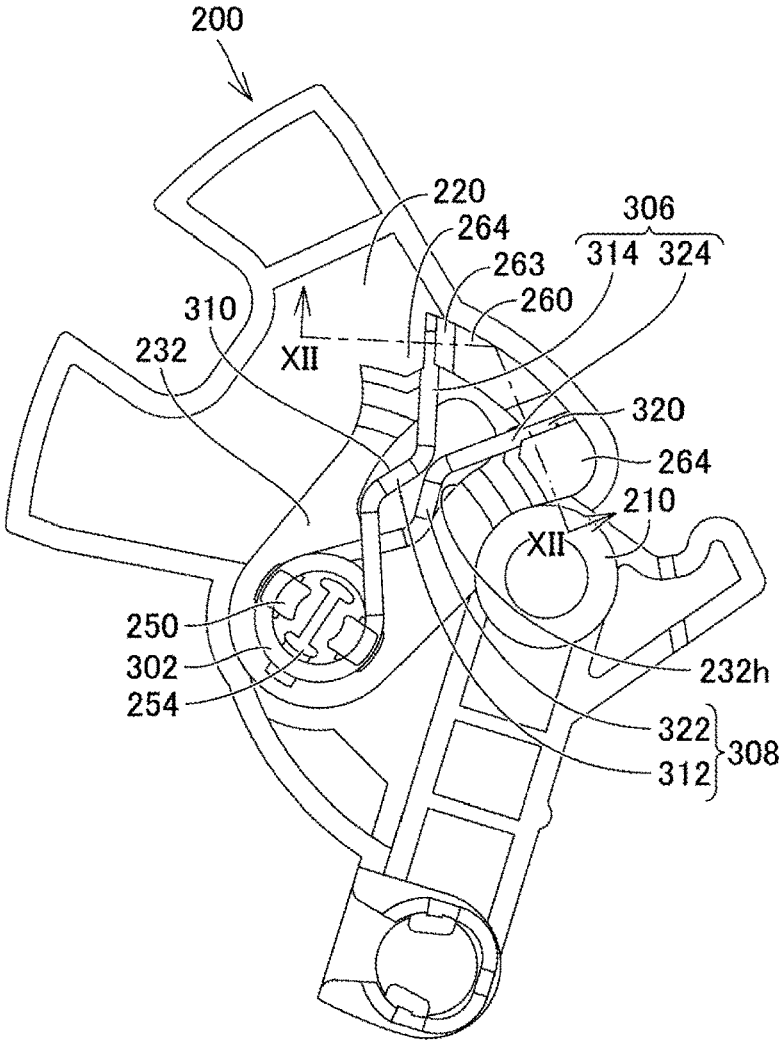
FIG. 11 is a plan view illustrating a state before the active lever and the spring are assembled to the housing.

FIG. 11 is a plan view illustrating a state before the active lever and the spring are assembled to the housing. Hereinafter, the active lever 200 and the spring 300 assembled to the active lever 200 are collectively referred to as an "assembly." That is, FIG. 11 is a plan view of the assembly.

The leg-portion holder 260 is a portion that holds the respective leg portions 310 and 320 in a state before the assembly is assembled to the housing 100 (the state illustrated in FIG. 11). In a state where the first leg portion 310 and the second leg portion 320 do not hold the held portion 104, i.e., in a state where the assembly is not assembled to the housing 100, the leg-portion holder 260 holds the first leg portion 310 and the second leg portion 320 in a state where the first leg portion 310 and the second leg portion 320 are spaced apart from each other so as to resist a restoration force by the coil portion 302. In a state where the first leg portion 310 and the second leg portion 320 hold the held portion 104, i.e., in a state where the assembly is assembled to the housing 100 (the state illustrated in FIG. 1), the leg-portion holder 260 is spaced apart from the first leg portion 310 and the second leg portion 320.

Figure 12:
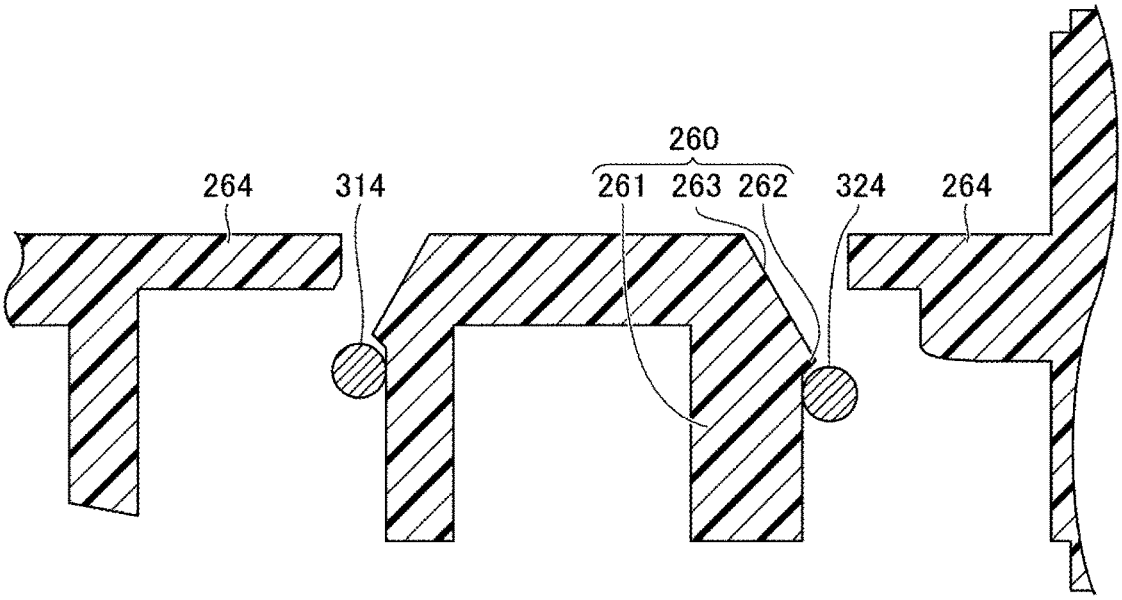
FIG. 12 is a cross-sectional view taken along line XII-XII in FIG. 11.

FIG. 12 is a cross-sectional view taken along line XII-XII in FIG. 11. As illustrated in FIG. 12, the leg-portion holder 260 includes a pinched portion 261, a retaining portion 262, and a guide portion 263.

The pinched portion 261 is a portion that is pinched by the second element 314 of the first leg portion 310 and the fourth element 324 of the second leg portion 320. In other words, the pinched portion 261 holds the second element 314 and the fourth element 324 in a state where the second element 314 and the fourth element 324 are spaced apart from each other such that the dimension between the second element 314 and the fourth element 324 is greater than the dimension between the second element 314 and the fourth element 324 in a state where no external force is applied to the respective leg portions 310 and 320. The pinched portion 261 has a shape that rises from the bottom wall 232 toward the cover 400.

The guide portion 263 is provided closer to the cover 400 side (the upper side in FIG. 12) than the pinched portion 261. The guide portion 263 has a shape that is inclined so as to become wider from the cover facing surface side to the base facing surface side in a direction opposite to the direction in which the clamping force by the second element 314 and the fourth element 324 acts.

The retaining portion 262 regulates the separation of the first leg portion 310 and the second leg portion 320 to the cover 400 side in a state where the first leg portion 310 and the second leg portion 320 pinch the pinched portion 261 therebetween. The retaining portion 262 has a shape that protrudes from the pinched portion 261 in a direction opposite to the direction in which the clamping force from the second element 314 and the fourth element 324 acts on the pinched portion 261. The retaining portion 262 is provided between the pinched portion 261 and the guide portion 263.

Figure 9:
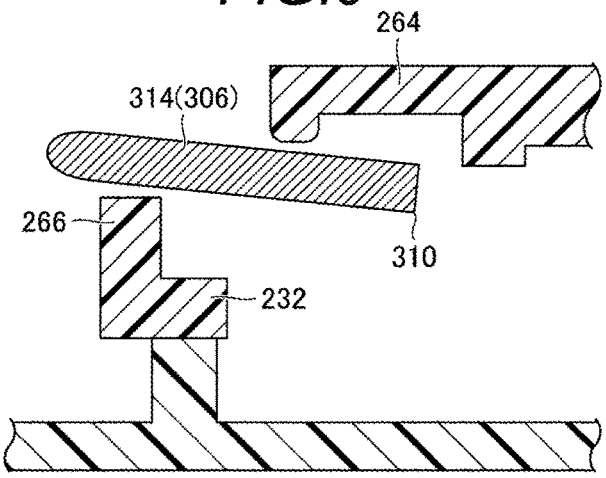
FIG. 9 is a cross-sectional view taken along line IX-IX in FIG. 6.

FIG. 9 is a cross-sectional view taken along line IX-IX in FIG. 6. As illustrated in FIGS. 9 and 3, the active lever 200 further includes a cover-side regulation portion 264 and a housing-side regulation portion 266.

The cover-side regulation portion 264 regulates the displacement of the first leg portion 310 and the second leg portion 320 to the cover 400 side (the upper side in FIG. 9) in a state where the first leg portion 310 and the second leg portion 320 are spaced apart from the leg-portion holder 260, i.e., in a state where the assembly is assembled to the housing 100 (the state illustrated in FIG. 1). The cover-side regulation portion 264 has a shape that overlaps, in the thickness direction (the vertical direction in FIG. 9) of the active lever 200, with the second element 314 and the fourth element 324 in a state where the assembly is assembled to the housing 100. The cover-side regulation portion 264 is connected to the lever connection portion 220. As illustrated in FIG. 12, the cover facing surface of the cover-side regulation portion 264 is set to the same height position as the upper end (the end on the cover 400 side) of the guide portion 263. The gap between the cover-side regulation portion 264 and the guide portion 263 is set to a size that allows the respective leg portions 310 and 320 to be inserted therethrough.

The housing-side regulation portion 266 regulates the displacement of the first leg portion 310 and the second leg portion 320 to the housing 100 side (the lower side in FIG. 9) in a state where the first leg portion 310 and the second leg portion 320 are spaced apart from the leg-portion holder 260, i.e., in a state where the assembly is assembled to the housing 100 (the state illustrated in FIG. 1). The housing-side regulation portion 266 has a shape that protrudes from the bottom wall 232 of the recess 230 toward the cover 400 side.

Next, a method of assembling the vehicle door lock structure will be described.

First, the assembly is formed by assembling the spring 300 to the active lever 200. Specifically, the coil portion 302 is assembled to the coil-portion holder 250 and the respective leg portions 310 and 320 are assembled to the leg-portion holder 260. The coil portion 302 is held by the coil-portion holder 250, so that the engagement portions 252 are engaged with the coil portion 302. Meanwhile, the respective leg portions 310 and 320 are pushed toward the guide portion 263 so as to be separated from each other along the guide portion 263 while resisting the restoration force of the coil portion 302. Then, by continuing to press the respective leg portions 310 and 320 as they are, the respective leg portions 310 and 320 pinch the pinched portion 261 therebetween after passing over the retaining portion 262. Thus, the assembly illustrated in FIG. 11 is formed.

Next, the assembly is assembled to the housing 100. Here, an example in which the assembly is assembled to the housing 100 such that the held portion 104 is held by the unlocked-position holder 308 will be described. That is, the rotating shaft portion 210 is assembled (pressed) to the support shaft 102 such that the held portion 104 is inserted through the insertion through-hole 232*h* from the base facing surface side toward the cover facing surface side of the active lever 200 and is further inserted between the first element 312 and the third element 322 which constitute the unlocked-position holder 308. Thus, the respective leg portions 310 and 320 are spaced apart from the pinched portion 261 of the leg-portion holder 260, and are located between the cover-side regulation portion 264 and the housing-side regulation portion 266. Thus, the assembling of the assembly to the housing 100 is completed (the state illustrated in FIGS. 1 and 6).

In addition, each member such as the inside open lever is assembled to the housing 100 before and after the assembling of the assembly to the housing 100.

Finally, the cover 400 is assembled to the housing 100. Specifically, the cover 400 is assembled to the housing 100 such that the cylindrical portion 402 is fitted onto the support shaft 102 and the fitting portion 404 is fitted onto the held portion 104.

As described above, in the vehicle door lock structure of the present embodiment, since the active lever 200 includes the spring holder 240, the active lever 200 and the spring 300 may be integrated with each other by assembling the spring 300 to the active lever 200. Therefore, first, an assembly including the active lever 200 and the spring 300 is constructed by assembling the spring 300 to the active lever 200, and the active lever 200 and the spring 300 may be easily assembled to the housing 100 by assembling the assembly to the housing 100 such that the locked-position holder 306 or the unlocked-position holder 308 of the assembly holds the held portion 104.

Further, since the active lever 200 is formed with the insertion through-hole 232*h* and the spring holder 240 is provided on the cover facing surface, when the assembly is assembled to the housing 100, it is possible to confirm, from the cover facing surface side, an assembling operation of holding the held portion 104 by the respective leg portions 310 and 320 while inserting the held portion 104 into the insertion through-hole 232*h*. Therefore, the assembling of the assembly to the housing 100 becomes easier.

Further, since the spring 300 is held by the spring holder 240, a clamping force from the respective leg portions 310 and 320 acts on the leg-portion holder 260 based on the restoration force of the coil portion 302. Therefore, the separation of the spring 300 from the spring holder 240 is effectively prevented.

Further, since the active lever 200 includes the cover-side regulation portion 264, the separation of the respective leg portions 310 and 320 from the active lever 200 in a state where the assembly is assembled to the housing 100 is prevented.

In addition, it should be understood that the embodiment disclosed this time is illustrative in all respects and not restrictive. The scope of this disclosure is illustrated not by the above description of the embodiments but by the scope of the claims, and further includes all modifications within the meaning and scope equivalent to the scope of the claims.

For example, when the held portion 104 moves between the locked-position holder 306 and the unlocked-position holder 308, a force by which a portion of the coil portion 302 on the side where the boundary portion 323 is located (the side far from the bottom wall 232) in a direction in which the respective boundary portions 313 and 323 are connected to each other is rotated so as to be separated from the bottom wall 232 is applied to the coil portion 302. Therefore, one of two engagement portions 252 connected to the pair of column portions 251 (the left engagement portion 252 in FIG. 8) may be omitted.

Further, the coil-portion holder 250 of the spring holder 240 may be omitted.

Further, the structure of the spring holder 240 is not limited to the example of the above-described embodiment as long as it may hold the spring 300. For example, the spring holder 240 may hold the spring 300 with a snap-fit structure different from the above embodiment. Further, for example, the coil portion 302 of the spring 300 may be held on the active lever 200 by a fastening member such as a screw. In this case, the fastening member constitutes the spring holder 240. Furthermore, the spring 300 may be integrated with the active lever 200 by the insert molding of a portion of the spring 300 into the active lever 200. In this case, a portion of the active lever 200 that holds a portion of the spring 300 constitutes the spring holder 240.

A vehicle door lock structure according to an aspect of the present disclosure includes a housing, an active lever supported by the housing so as to be displaceable relative to the housing between a locked position where the active lever prohibits opening of a vehicle door by a door opening operation of a door operation handle provided on the vehicle door and an unlocked position where the active lever allows the opening of the vehicle door by the door opening operation of the door operation handle, and a spring configured to selectively hold the active lever at either the locked position or the unlocked position. The housing includes a held portion that is held by the spring, the spring includes a locked-position holder that holds the held portion such that the active lever is held at the locked position and an unlocked-position holder that holds the held portion such that the active lever is held at the unlocked position, and the active lever includes a spring holder that holds the spring.

In the vehicle door lock structure, since the active lever includes the spring holder, the active lever and the spring may be integrated with each other by assembling the spring to the active lever. Therefore, first, an assembly including the active lever and the spring is constructed by assembling the spring to the active lever, and the active lever and the spring may be easily assembled to the housing by assembling the assembly to the housing such that the locked-position holder or the unlocked-position holder of the assembly holds the held portion.

The vehicle door lock structure may further include a cover capable of being assembled to the housing and configured to accommodate therein the active lever and the spring together with the housing in a state of being assembled to the housing, the housing may include a base that faces the cover, the held portion may have a shape that protrudes from the base toward the cover, and the active lever may have a base facing surface that faces the base and a cover facing surface that faces the cover. In this case, it is preferable that the active lever is formed with an insertion through-hole that allows the held portion to be inserted therethrough from a base facing surface side to a cover facing surface side and allows the active lever to be displaced between the locked position and the unlocked position in a state where the held portion is inserted through the insertion through-hole, and the spring holder is provided on the cover facing surface.

In this aspect, since it is possible to confirm, from the cover facing surface side, an assembling operation of holding the held portion by the spring while inserting the held portion into the insertion through-hole, the assembling of the assembly to the housing becomes easier.

Further, the spring may include a coil portion, a first leg portion that extends from one end of the coil portion, and a second leg portion that extends from a remaining end of the coil portion, a portion of the first leg portion and a portion of the second leg portion may constitute the locked-position holder, and another portion of the first leg portion and another portion of the second leg portion may constitute the unlocked-position holder. In this case, it is preferable that the spring holder includes a leg-portion holder that holds, in a state where the first leg portion and the second leg portion do not hold the held portion, the first leg portion and the second leg portion in a state where the first leg portion and the second leg portion are spaced apart from each other so as to resist a restoration force by the coil portion, the leg-portion holder being spaced apart from the first leg portion and the second leg portion in a state where the first leg portion and the second leg portion hold the held portion.

With this configuration, since a clamping force from the respective leg portions acts on the leg-portion holder based on the restoration force of the coil portion, the separation of the spring from the spring holder is effectively prevented.

Further, it is preferable that the leg-portion holder includes a pinched portion that is pinched between the first leg portion and the second leg portion, and a retaining portion that regulates separation of the first leg portion and the second leg portion to a cover side in a state where the first leg portion and the second leg portion pinch the pinched portion therebetween.

With this configuration, the separation of the respective leg portions from the leg-portion holder is prevented.

Further, it is preferable that the active lever includes a cover-side regulation portion that regulates displacement of the first leg portion and the second leg portion to the cover side in a state where the first leg portion and the second leg portion are spaced apart from the leg-portion holder.

With this configuration, the separation of the respective leg portions from the active lever in a state where the first leg portion and the second leg portion are spaced apart from the leg-portion holder, i.e., in a state where the assembly is assembled to the housing is prevented.

Further, it is preferable that the active lever includes a housing-side regulation portion that regulates displacement of the first leg portion and the second leg portion to a housing side in a state where the first leg portion and the second leg portion are spaced apart from the leg-portion holder.

With this configuration, the separation of the respective leg portions from the active lever in a state where the assembly is assembled to the housing is prevented.

Further, the cover may include a fitting portion that is fitted onto the held portion. In this case, it is preferable that the fitting portion has a shape that overlaps with the first leg portion and the second leg portion in a direction parallel to an axial direction of the held portion.

With this configuration, the separation of the respective leg portions from the active lever in a state where the assembly is assembled to the housing is prevented.

Further, it is preferable that each of the first leg portion and the second leg portion includes a moderator formed between the locked-position holder and the unlocked-position holder to generate a moderation feeling when the held portion moves between the locked-position holder and the unlocked-position holder.

With this configuration, a moderation feeling is generated when the active lever is switched between the locked position and the unlocked position.

Further, it is preferable that the spring holder includes a coil-portion holder that holds the coil portion, and the coil-portion holder includes an engagement portion that regulates displacement of the coil portion to the cover side.

With this configuration, the separation of the coil portion from the coil-portion holder is prevented.

Further, it is preferable that the engagement portion is engaged with a portion of the coil portion that is displaced toward the cover side when the held portion moves between the locked-position holder and the unlocked-position holder.

With this configuration, the separation of the coil portion from the coil-portion holder is more reliably prevented.

As described above, according to the aspect of this disclosure, it is possible to provide a vehicle door lock structure in which an active lever and a spring may be easily assembled to a housing.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A vehicle door lock structure comprising:

a housing;

an active lever supported by the housing so as to be displaceable relative to the housing between a locked position where the active lever prohibits opening of a vehicle door by a door opening operation of a door operation handle provided on the vehicle door and an unlocked position where the active lever allows the opening of the vehicle door by the door opening operation of the door operation handle;

a spring configured to selectively hold the active lever at either the locked position or the unlocked position; and a cover capable of being assembled to the housing and configured to accommodate therein the active lever and the spring together with the housing in a state of being assembled to the housing, wherein the housing includes a base that faces the cover and a held portion that is held by the spring, the held portion having a shape that protrudes from the base toward the cover, the spring includes:

a locked-position holder that holds the held portion such that the active lever is held at the locked position;

an unlocked-position holder that holds the held portion such that the active lever is held at the unlocked position;

a coil portion;

a first leg portion that extends from one end of the coil portion; and a second leg portion that extends from a remaining end of the coil portion, a portion of the first leg portion and a portion of the second leg portion constitute the locked-position holder, another portion of the first leg portion and another portion of the second leg portion constitute the unlocked-position holder, the active lever includes a spring holder that holds the spring, a base facing surface that faces the base, and a cover facing surface that faces the cover, the spring holder includes a leg-portion holder that holds, in a state where the first leg portion and the second leg portion do not hold the held portion, the first leg portion and the second leg portion in a state where the first leg portion and the second leg portion are spaced apart from each other so as to resist a restoration force by the coil portion, the leg-portion holder being spaced apart from the first leg portion and the second leg portion in a state where the first leg portion and the second leg portion hold the held portion, the active lever is formed with an insertion through-hole that allows the held portion to be inserted therethrough from a base facing surface side to a cover facing surface side and allows the active lever to be displaced between the locked position and the unlocked position in a state where the held portion is inserted through the insertion through-hole, the spring holder is provided on the cover facing surface, the spring holder includes a coil-portion holder that holds the coil portion, the coil-portion holder includes an engagement portion that regulates displacement of the coil portion to a cover side, and the active lever includes:

a cover-side regulation portion that regulates displacement of the first leg portion and the second leg portion to a cover side in a state where the first leg portion and the second leg portion are spaced apart from the leg-portion holder; and a housing-side regulation portion that regulates displacement of the first leg portion and the second leg portion to a housing side in a state where the first leg portion and the second leg portion are spaced apart from the leg-portion holder.

2. The vehicle door lock structure according to claim 1, wherein the leg-portion holder includes:

a pinched portion that is pinched between the first leg portion and the second leg portion; and a retaining portion that regulates separation of the first leg portion and the second leg portion to a cover side in a state where the first leg portion and the second leg portion pinch the pinched portion therebetween.

3. The vehicle door lock structure according to claim 1, wherein the cover includes a fitting portion that is fitted onto the held portion, and the fitting portion has a shape that overlaps with the first leg portion and the second leg portion in a direction parallel to an axial direction of the held portion.

4. The vehicle door lock structure according to claim 1, wherein the first leg portion and the second leg portion include a moderator formed between the locked-position holder and the unlocked-position holder to generate a moderation feeling when the held portion moves between the locked-position holder and the unlocked-position holder.

5. The vehicle door lock structure according to claim 1, wherein the engagement portion is engaged with a portion of the coil portion that is displaced toward the cover side when the held portion moves between the locked-position holder and the unlocked-position holder.

* * * * *